United States Patent [19]

Ikeno

[11] 4,173,848

[45] Nov. 13, 1979

[54] POLISHING DEVICE

[75] Inventor: Hitoshi Ikeno, Tokyo, Japan

[73] Assignee: Kabushiki Kaisha Seikosha, Japan

[21] Appl. No.: 821,573

[22] Filed: Aug. 3, 1977

[30] Foreign Application Priority Data

Aug. 3, 1976 [JP] Japan ..... 51-92483
Aug. 3, 1976 [JP] Japan ..... 51-92484
Aug. 3, 1976 [JP] Japan ..... 51-92485

[51] Int. Cl.[2] ..... B24B 13/00; B24B 41/04

[52] U.S. Cl. ..... 51/55; 51/124 R; 51/235

[58] Field of Search ..... 51/55, 124 L, 124 R, 51/216 LP, 235; 269/21; 279/3

[56] References Cited

U.S. PATENT DOCUMENTS

| | | | |
|---|---|---|---|
| 2,278,314 | 3/1942 | Houchin | 51/124 L |
| 2,381,449 | 8/1945 | Holman | 51/55 |
| 2,406,789 | 9/1946 | Bardwell | 51/124 L |
| 2,799,974 | 7/1957 | Andrysick | 51/55 |
| 2,955,390 | 10/1960 | Phillips | 51/124 L |
| 3,318,065 | 5/1967 | Shazor | 279/3 X |
| 3,833,230 | 9/1974 | Noll | 51/235 X |
| 3,838,865 | 10/1974 | Roberts | 51/235 X |

*Primary Examiner*—Gary L. Smith
*Attorney, Agent, or Firm*—Robert E. Burns; Emmanuel J. Lobato; Bruce L. Adams

[57] ABSTRACT

A device for polishing plano-convex lenses, quartz oscillators and the like comprises a lapping dish having a concave spherical surface and mounted for oscillating and rotary movement. The material to be polished is held by a suction rotary chuck which applies the material to be polished against the lapping dish with a selected pressure. Separate motors are provided for rotating and oscillating the lapping dish and for rotating the material to be polished.

6 Claims, 8 Drawing Figures

POLISHING DEVICE

FIELD OF INVENTION

The present invention relates to a device for polishing plano-convex lenses, quartz oscillators and the like.

BACKGROUND OF THE INVENTION

Since there is no suitable method for processing plano-convex quartz oscillators they have seldom been put to practical use although a few large-sized oscillators of this kind have been used. According to one of the conventional methods of processing this kind of quartz oscillators, they are polished by hand or quartz pieces are applied by the fingers to a concave spherical lapping dish to be processed. Such processing by hand is inefficient and results in increased cost. In such processing by hand it is difficult to achieve uniform polishing. Moreover, there is the possibility that uneven polishing may result in spoiling the cut angles of the quartz blank. This results in deterioration in the temperature characteristics of the oscillator. The conventional methods of polishing plano-convex quartz oscillators thus have serious drawbacks.

When a quartz oscillator is polished by using a polishing machine for spherical surfaces of lenses, quartz pieces are bonded together with a bonding agent. However, difficulty arises from the fact that the thickness of bonded layers are not uniform. This is liable to cause partial over-polishing and moreover it is difficult to measure the thickness of the quartz pieces.

SUMMARY OF THE INVENTION

The present invention provides a polishing device in which a lapping dish having a concave spherical surface is oscillated to polish quartz oscillators. This device permits avoiding partial over-polishing as well as obtaining an accurate angle of the spherical surface.

The present invention also permits piezoelectric detection of material to be polished such as a quartz oscillator so that the thickness of the material to be polished can be easily measured.

The present invention further provides a polishing device which permits automatic polishing of materials.

BRIEF DESCRIPTION OF DRAWINGS

The nature, objects and advantages of the invention will be more fully understood from the following description of a preferred embodiment in conjunction with the accompanying drawings in which.

DESCRIPTION OF PREFERRED EMBODIMENT

Figure 1:
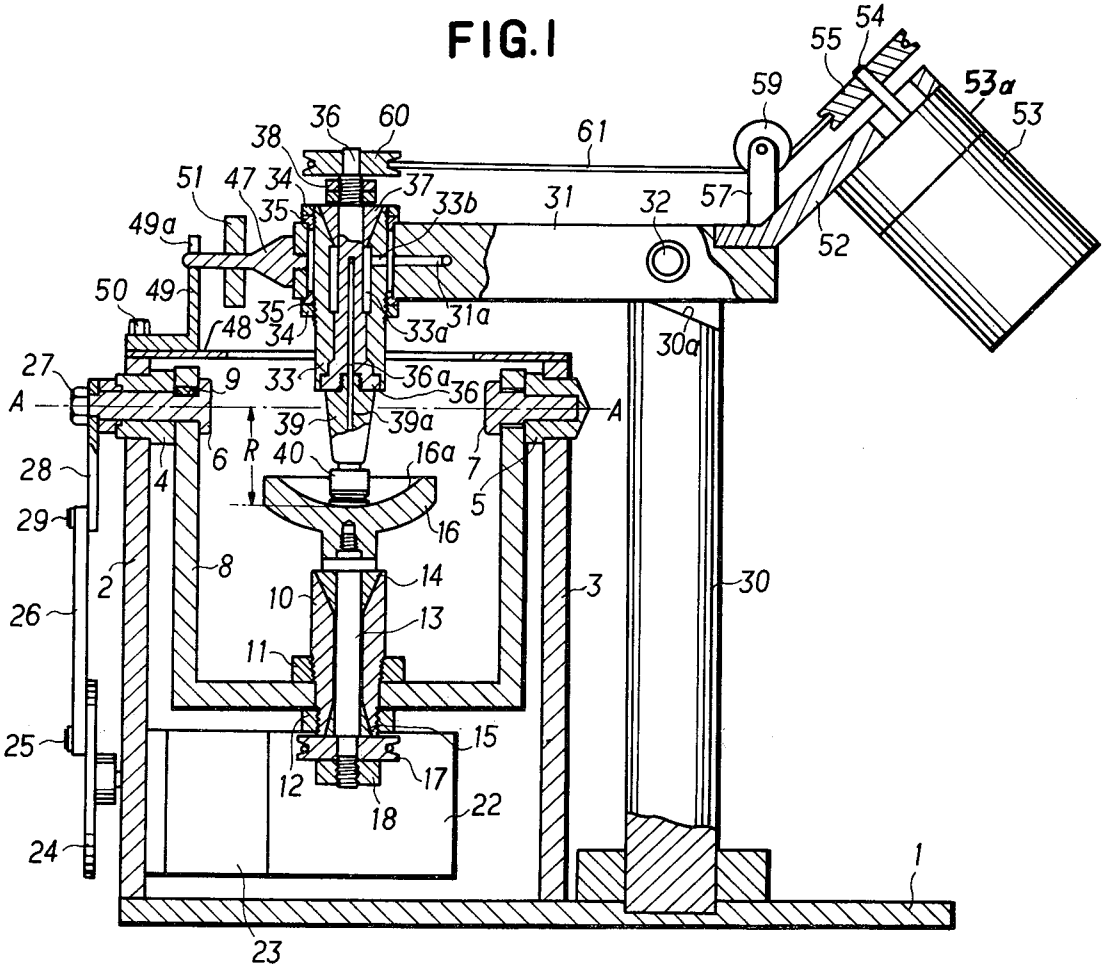
FIG. 1 is a cross sectional view of a polishing device in accordance with the present invention.
Figure 2:
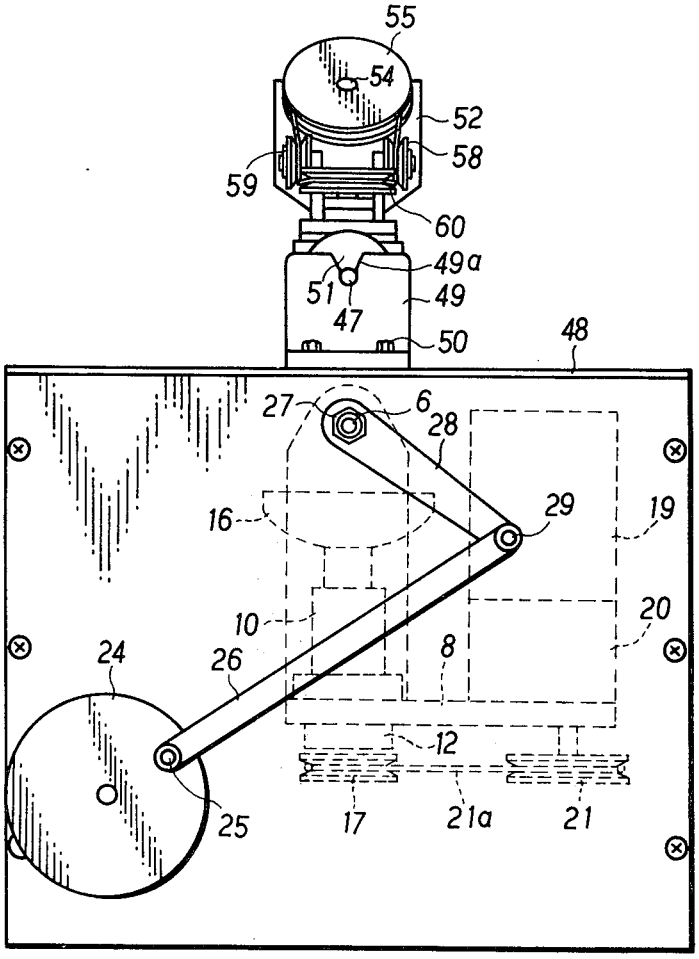
FIG. 2 is a side elevational view taken from the left-hand side.

The polishing device shown by way of example in the drawings comprises a base plate 1 on which parallel frame plates 2 and 3 are set up at a selected distance from one another. Upper portions of frame plates 2 and 3 support bearings 4 and 5 respectively. An arm shaft 6 is rotatably supported by bearing 4 while an arm shaft 7 is firmly fitted in bearing 5. An oscillating member 8 is suspended from the arm shafts 6 and 7, being secured to the arm shaft 6 by a key 9 and being loosely fitted on the arm shaft 7. The oscillating member 8 is thus oscillatable about an axis defined by the arm shafts 6 and 7. A bearing 10 extends through the bottom plate of the oscillating member 8 and is fastened to the bottom plate with nuts 11 and 12. In the bearing 10, a shaft 13 is rotatably supported by bearing portions 14 and 15. A lapping dish 16 is screwed onto the threaded upper end of the shaft 13 while a pully 17 is mounted on the lower end of the shaft by means of a nut 18. On the lapping dish 16 there is formed a concave spherical polishing surface **16*a* which has a radius corresponding to the distance R between the axis A—A of arm shafts 6 and 7 and the spherical polishing surface 16*a***.

The lapping dish 16 is rotatable by a motor 19, a reducing mechanism 20, a pulley 21 on the output shaft of the reducing mechanism and a belt **21*a* connecting the pulley 21 with the pulley 17 on the lower end of the shaft 13 on which the lapping dish is mounted. Means for oscillating the oscillating member 8 comprises a motor 22, a reducing mechanism 23 and a rotary disc 24 mounted on the output shaft of the reducing mechanism. A link 26 connects an eccentric pin 25 on the rotary disc 24 with a pin 29 at one end of an arm 28 which is fixed to the arm shaft 6 with a nut 27. As the disc 24 rotates, the oscillating member 8** is oscillated through a selected angle.

A chucking means for chucking a workpiece to be polished and means for rotating the chucking means will now be described.

As illustrated in FIG. 1 a support post 30 is fixedly set up on the base plate 1 along side the frame plate 3. On the upper end of the post 30 an arm 31 is pivotedly supported by means of a shaft 32. An inclined upper surface **30*a* on the post 30 regulates the rotary angle of the arm 31. A bearing 33 extends vertically through the front end portion of arm 31 above the lapping dish 16 and is secured by nuts 34 and insulating bushings 35. When piezoelectric detection is not required, the insulating bushings 35 are not necessary. A rotary shaft 36 is rotatably inserted in the bearing 33 and is supported in a fixed position by a bearing portion 37 and a double nut 38. The upper end of a rotary shaft 39 is screw-connected to the lower end of the rotary shaft 36 and chucking means 40 is provided at the lower end of the rotary shaft 39**.

An annular recess **33*a* is provided in the central portion of the inner circumferential surface of the bearing 33 and hollow portions 33*b* and 31*a* provided in the bearing 33 and arm 31 respectively communicate with the recess 33*a*. The recess 33*a* communicates with central bores 36*a* and 39*a* which extend through rotary shafts 36 and 39** respectively. Means is thereby provided for applying suction to the chucking means which will now be described.

Figure 4:
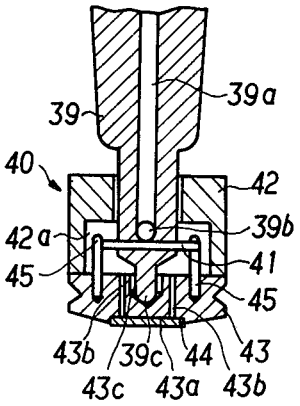
FIG. 4 is a cross sectional view of chucking means holding an oscillator to be polished.
Figure 5:
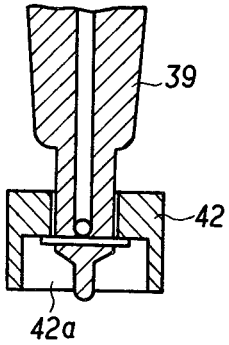
FIG 5 is a cross sectional view of the chucking means with the oscillator holding portion removed.

The construction of the chucking means 40 attached to the lower end of rotary shaft 29 is shown in FIGS. 4 and 5. In the lower portion of the rotary shaft 39 there is provided a suction opening **39*b* for the central bore 39*a*. Below the opening 39*b* a shaft 41 extends transversely through the rotary shaft 39. Below the shaft 41 the rotary shaft 39** is of reduced cross section and terminates in a hemispherical end portion 39*c*. Around the lower end portion of the rotary shaft 39 a cover member 42 is provided with a small gap therebetween so that the cover member 42 is vertically moveable. The cover member 42 has an inner recess 42*a* and is prevented by the shaft 41 from coming off of the rotary shaft 39 as illustrated in FIG. 5. When the shaft 41 contacts cover member 42, the suction opening 39*b* is thereby closed.

A chuck 43 adapted to sit against the lower edge of the cover member 42 is provided in its lower surface with a recess 43*a* for receiving the workpiece to be polished. Narrow passages 43*b* extend from the recess 43*a* to the upper surface of the chuck 43. In the center of the upper surface of the chuck 43 there is provided a conical recess 43*c* which receives the hemispherical portion 39*c* at the lower end of rotary shaft 39 with a gap therebetween. Driving pins 45 extend downwardly from the transverse shaft 41 and are received in holes in the chuck 43 so as to rotate the chuck 43 together with the rotary shaft 39. Since there is a small gap between the cover 42 and the rotary shaft 39, the upper surface of the chuck 43 and lower surface of the cover member 42 are always in close contact with each other even when the chuck 43 is slightly inclined.

Figure 6:
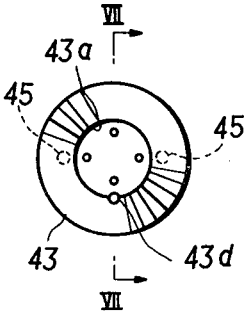
FIG. 6 is a bottom plan view of the chucking means.
Figure 7:
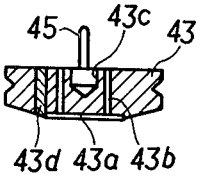
FIG. 7 is a cross sectional view taken along the line VII—VII in FIG. 6.
Figure 8:
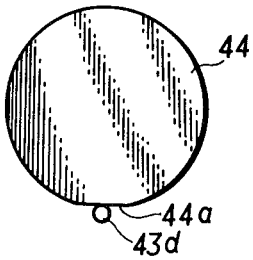
FIG. 8 is an enlarged view of material to be polished.

A workpiece 44 to be polished is held by the chuck 43 without being bonded thereto with a bonding agent and hence piezoelectricity can easily be detected when a piezoelectric elememt such as a quartz piece is being polished. When a pin 43*d* is provided in the lower face of the chuck 43 at the edge of the recess 43*a* as shown in FIGS. 6 to 8 the workpiece to be polished is provided with a cut side 44*a* which is engaged by the pin 43*d* to assure rotation of the workpiece with the chuck. Moreover, this is advantageous in the detection of piezoelectricity.

Figure 3:
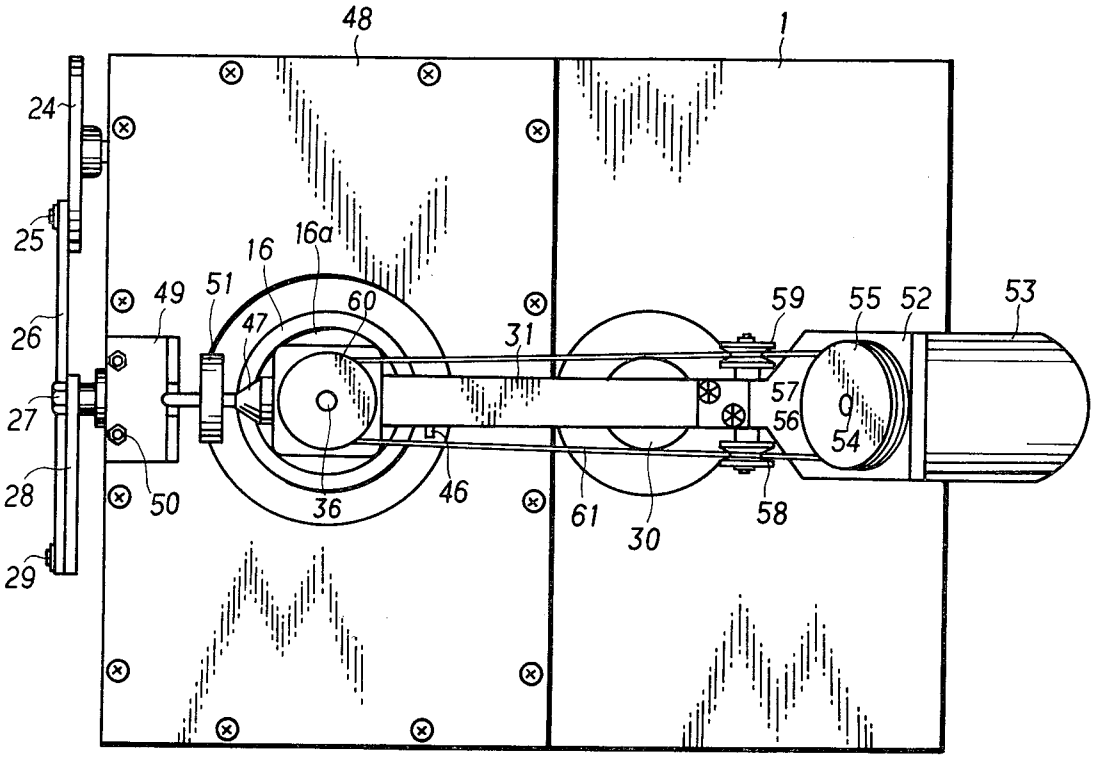
FIG. 3 is a plan view.

The hollow portions 31*a*, 33*b*, annular recess 33*a* and central bores 36*a* and 39*a* in the shafts 36 and 39 respectively constitute a pressure reducing passage extending from the chuck to a nozzle 46 which projects laterally from arm 31 as shown in FIG. 3. This nozzle 46 is connected to a pressure reducing or vacuum pump (not shown) so that the pressure in inner recess 42*a* of cover member 42 is reduced. When a workpiece 44 that is to be polished is placed in the recess 43*a* of the chuck 43 and the chuck 43 is placed on the lower end of the shaft 39, the reduced pressure supplied through the pressure reducing passage maintains the chuck on the shaft 39 and holds the workpiece on the chuck as shown in FIG. 4.

Means for pressing the workpiece 44 to be polished against the concave spherical polishing surface 16*a* of the lapping dish 16 will now be described. An engagement projection 47 is screw connected to the free end portion of the pivoted arm 31. On one end of a cover plate 48 placed on the upper end surfaces of frame plates 2 and 3 an L-shaped stopping plate 49 is secured by nuts 50. At its upper edge the stopping plate 49 is provided with an engagement groove 49*a* for receiving the engagement projection 47 on the end of arm 31. A weight 51 is fitted on a reduced portion of the engagement projection 47 and is moveable along the projection in order to adjust the pressure to be applied to the workpiece.

Means for driving the rotary shaft 36 and thereby rotating the chucking means 40 will now be described. A motor 53 with a reducing mechanism 53*a* is mounted on an angular installation plate which projects from the base end of the pivoted arm 31. A belt 61 runs on a pulley 55 mounted on the driving shaft 54 of the motor 53, under guide pulleys 58,59 supported by bearings 56, 57 respectively which are mounted on opposite side surfaces of arm 31 and around a pulley 60 mounted on the upper end of the rotary shaft 36. The rotary shaft 36 and 39 together with the chucking device 40 are thereby rotatively driven by the motor 53.

The operation of the polishing device in accordance with the present invention will now be described. The arm 31 is rocked counterclockwise around the shaft 32 from the position shown in FIG. 1 in order to raise the free-end of the arm and thereby raise the chucking means. At this time the chucking means is in the condition shown in FIG. 5. A work-piece 44 to be polished is fitted in the recess 43*a* in the lower surface of chuck 43 and is held by the fingers so that it is in the condition shown in FIG. 4. Then the pressure in the inside of inner recess 42*a* in the cover member 42 is reduced by the suction means. Consequently, the material 44 to be polished is held on the chuck by suction applied through the narrow passages 43*b* and the chuck 43 is held on the lower end of the rotary shaft 49.

The arm 31 is then rocked in a counterclockwise direction to bring the material 44 to be polished into contact with the concave spherical polishing surface 16*a* of the lapping dish 16 so that the material 44 is pressed against the concave spherical polishing surface 16*a* by the weight 51. The force of pressing the workpiece 44 against the concave polishing surface 16*a* is applied only in the direction in which the engagement projection 47 is engaged with the groove 49*a* in the stopping plate 49. When the motors 19, 22 and 53 are driven, the lapping dish 16 is rotated while being oscillated and the chucking means 40 holding the material 44 to be polished is also rotated. At this time a polishing agent is supplied to the concave spherical polishing surface 16*a*. Since the center of the spherical polishing surface 16*a* of the lapping dish 16 coincides with the center of oscillation of the oscillating member 8, there is no possibility of the work-piece being unevenly polished. In addition the hemispherical portion 39*c* at the lower end of rotary shaft 39 presses with a degree of freedom in the conical recess 43*c* of chuck 43 and there is a small gap between the rotary shaft 39 and the cover member 42. Therefore even if the rotary shaft 39 and chuck 43 are inclined, the whole circumference of the workpiece 44 uniformly contacts the spherical polishing surface 16*a*. Thus the work-piece 44 is uniformly polished. The rotational speed of that portion of the spherical polishing surface which is near the center thereof is low and the polishing speed of such portion is also low. Consequently, the polishing time can be shortened if the oscillatory movement of the oscillating member 8 does not cover the center portion thereof.

After the polishing process has been finished motors 19, 22, and 53 are stopped first to cease rotary oscillatory movement of the lapping dish 16 and rotary movement of the chucking means 40. Then arm 31 is raised to stop the pressure reducing pump. At this time the reduced pressure does not act on the chucking means 40 and accordingly chuck 43 is ready to be removed. When chuck 43 has been removed, cover member 42 moves downwardly by its own weight to the position shown in FIG. 5 to close the suction opening 49*b*. Then the work-piece 44 is easily removed from the chuck 43.

In the embodiment of this invention, as illustrated by way of example in the drawings, the workpiece 44 is a plano-convex quartz oscillator to be polished. However the device of the present invention also permits polishing biconvex type and bevel type quartz oscillators. When a biconvex type quartz oscillator is to be polished, a chuck having a spherically formed recess for receiving the work-piece to be polished is provided and the bi-convex work-piece is polished first on one side and then on the other.

It is sufficient that either the lapping dish 16 or chucking means 40 is rotated. When both the lapping dish and chucking means are rotated, the polishing time can be shortened to a considerable extent.

If the device is set before use so that the polishing operation may be automatically stopped when the material has been polished as desired by detecting an electrical signal which is indicative of the polishing condition of the material and which has a specific frequency generated when the material is polished, the polishing operation can be conducted very rapidly.

What is claimed is:

1. A device for polishing a convex surface of a quartz oscillator comprising a base, an oscillating member, means mounting said oscillating member on said base for oscillation about a horizontal axis, a lapping dish disposed on said oscillating member and having an upwardly facing concave spherical lapping surface having a center of curvature essentially coinciding with the axis of oscillation of said oscillating member, a support arm pivotally mounted on said base for pivotal movement about a horizontal axis between an upper raised position and a lower operative position, a hollow shaft carried by said arm in position to be essentially vertical when said arm is in operative position, said shaft having an axially extending bore, a chuck for holding a quartz blank on the lower end of said shaft in position to engage said lapping surface of said lapping dish, said chuck being supported on said shaft by a ball and socket joint permitting limited tilting of said chuck relative to said shaft and having a surface for receiving and positioning said blank and suction passages leading to said blank receiving surface, means connecting said passages with said bore of said shaft, means for applying suction to the bore of said shaft and hence to said chuck and to said passages and said blank receiving surface to hold said chuck on the lower end of said shaft by suction and to hold a blank on said blank receiving surface of said chuck by suction, means for oscillating said oscillating member about said oscillation axis and means for concurrently rotating said chuck and said lapping dish relative to one another.

2. A polishing device according to claim 1, wherein a projection is provided on said arm and a guide portion provided on said base has a guiding groove to receive and guide said projection and thereby guide and position said arm.

3. A polishing device according to claim 1, wherein said shaft is rotatably supported by said arm and means is provided for rotating said shaft and thereby rotating said chuck.

4. A polishing device according to claim 1, wherein a cover loosely slidable on a lower end portion of said shaft is engageable by said chuck and comprises said means for connecting said suction passages of said chuck with said bore of said shaft.

5. A polishing device according to claim 1, wherein a blank held on said chuck is pressed against said lapping surface of said lapping dish by the weight of said arm and in which means is provided on said arm for varying the pressure it applies to said blank.

6. A polishing device according to claim 1, wherein said lapping dish is supported by a shaft rotatably mounted on said oscillating member and means is provided for rotating said shaft and said lapping dish.

* * * * *